United States Patent [19]

Kemka

[11] Patent Number: 4,634,201

[45] Date of Patent: Jan. 6, 1987

[54] CONNECTOR/NITINOL Δ CONTACT FORCE DEVICE

[75] Inventor: Rudy F. Kemka, Hillsdale, N.J.

[73] Assignee: The United States of America as represented by the Department of the Navy, Washington, D.C.

[21] Appl. No.: 607,477

[22] Filed: May 7, 1984

[51] Int. Cl.[4] ..... H01R 13/20

[52] U.S. Cl. ..... 339/30; 339/DIG. 1

[58] Field of Search ..... 339/30, DIG. 1

[56] References Cited

U.S. PATENT DOCUMENTS

| | | | |
|---|---|---|---|
| 3,569,901 | 3/1971 | Connor | 339/30 |
| 3,740,839 | 6/1973 | Otte et al. | 339/30 |
| 3,861,030 | 1/1975 | Otte et al. | 339/30 |
| 3,913,444 | 10/1975 | Otte | 339/30 |
| 4,462,651 | 7/1984 | McGaffigan | 339/30 |

*Primary Examiner*—Gil Weidenfield
*Assistant Examiner*—Paula A. Austin
*Attorney, Agent, or Firm*—Arthur A. McGill; Prithvi C. Lall; Michael J. McGowan

[57] ABSTRACT

An electrical connector employs a pin and socket mechanism enclosed by a contact force device. The contact force device has a uniqueness so that after insertion of the pin in the socket with the device at a very low temperature is completed, the device is allowed to return to ambient temperature. The separation force of the pin and socket mechanism is much greater than the insertion force. The contact force device uses nitinol and takes advantage of its transformation temperature in shifting from austenite phase to martensite phase and vice-versa.

3 Claims, 5 Drawing Figures

CONNECTOR/NITINOL Δ CONTACT FORCE DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention is an electrical connector. It has unique components in both material and configuration that result in the pin and receptacle after mating being locked in place at ambient temperature. There are no locking components to be manipulated.

(2) Description of the Prior Art

Prior connectors use various locking mechanisms such as threads or no locking mechanism at all. Where no locking mechanism is used there is always the danger of someone accidentally pulling on wires and causing disconnection of the mating components. On prior art devices vibrations and shock have posed additional problems. One prior art device to overcome these difficulties uses a heat shrinkable plastic material to enclose both the metallic pin and receptacle.

SUMMARY OF THE INVENTION

The present invention eliminates prior art problems by providing improved contact characteristics. The metallic device forming the receptacle has a contact device enclosing it that is cooled to its martensite phase. After insertion of the pin the device is permitted to return to ambient temperature which causes the contact device to return to its austenite phase and securely grip the pin. If removal of the pin is desired, the contact device should again be cooled to its martensite phase.

DESCRIPTION OF THE PREFERRED EMBODIMENT

Figure 1A:
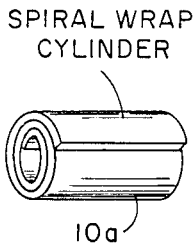
FIGS. 1*a*, 1*b* and 1*c* are various Δ contact devices in accordance with the present invention.
Figure 1B:
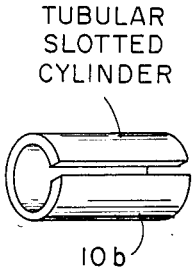
Figure 1C:
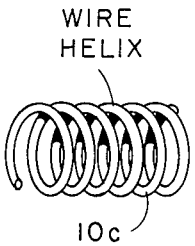

Referring now to FIGS. 1*a*, 1*b* and 1*c* there are shown respectively three different arrangements of Δ contact force devices 10*a*, 10*b* and 10*c*. FIG. 1*a* shows the Δ contact force device 10*a* in the shape of a flat sheet formed into a spiral wrap cylinder. FIG. 1*b* shows the Δ contact force device 10*b* in the shape of a flat sheet formed into a slotted cylinder. FIG. 1*c* has the Δ contact force device 10*c* in the shape of round wire formed into a helix. Obviously rectangular wire could be used as well. All of these contact force devices 10*a*, 10*b* and 10*c* are made of a material such as nitinol with a transformable grain structure from austenite to martensite.

Figure 2:
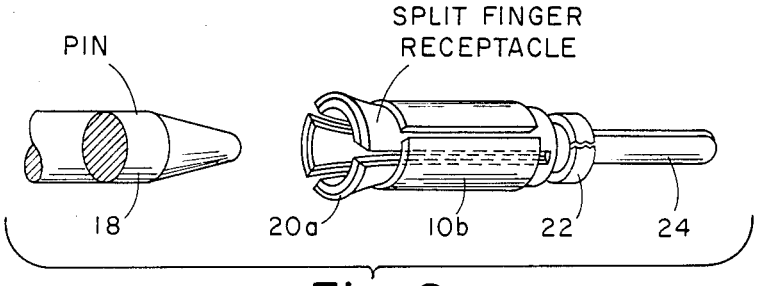
FIG. 2 is a first embodiment of the present invention.

FIG. 2 shows a partially exploded view of a connector assembly. The assembly has a pin 18 of circular cross section that can be fabricated from brass or other suitable conductive material. The diameter of the pin 18 in the contact area is $D_m$.

A socket 20*a* for receiving the pin 18 is in the form of a split finger cylinder. The split finger cylindrical socket 20*a* has a collar 22 and a soldered or welded tab 24. The socket 20 can be fabricated from work hardenable or heat treatable conductive spring material such as phosphor bronze or beryllium. The finished opening or set diameter of the socket 20*a* in the contact area with the pin 18 is:

$$D_m - \delta \qquad \text{(Eq. 1)}$$

wherein $D_m$ is the diameter of the pin 18, and $\delta$ is the reduction of diameter required to insure positive wiping action and good electrical contact.

The tubular slotted cylinder nitinol Δ contact force device 10*b* is placed over the outer diameter of the socket 20*a* and is in intimate contact with the outer diameter of the socket 20*a* when the inner diameter of the socket 20*a* is maintained at the set diameter. This occurs at room temperature. The means effective inner diameter of device 10*b* is $D_\Delta$. This diameter permits the installation of the device 10*b* over the socket 20*a* without introducing strain. Δ contact devices 10*a* and 10*c* are also suitable for use in place of device 10*b*.

The nitinol Δ contact force device 10*b* should have a transformation temperature in the range of −40° C. to −10° C. The transformation temperature is a function of the specific nitinol alloy and can be varied to suit specific applications. During mating the strain experienced by the nitinol Δ contact force device 10*b* should be limited to 6–8% to permit complete recovery to the original shape. If necessary a tube can be placed over the nitinol device 10*b* to limit the excursion during mating. Nitinol Δ contact devices 10*a* and 10*c* suitable for use in place of device 10*b*.

Figure 3:
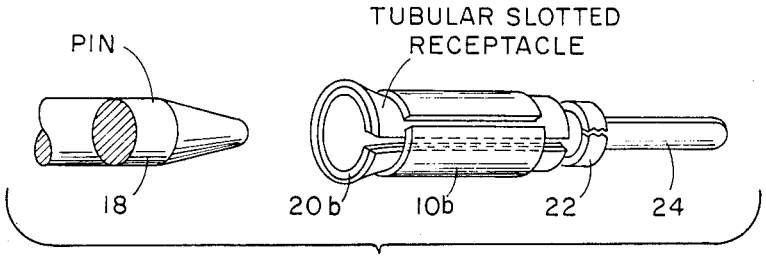
FIG. 3 is an alternate embodiment of the present invention.

In order to insert the pin 18 into the split finger receptacle 20*a* as shown in FIG. 2 or the tubular slotted cylinder 20*b* as shown in FIG. 3 the receptacle 20*a* or 20*b* is cooled with liquid nitrogen. This transforms the grain structure of the nitinol device 10*b* from austenite to martensite, where a lower modulus and a lower yield strength permit relatively easy deformation of the original room temperature shape. As the pin 18 is inserted the diameter of the receptacle 20*a* or 20*b* is expanded from $D_m - \delta$ to $D_m$ and the diameter of the nitinol Δ device 10*b* is expanded from $D_\Delta$ to $D_\Delta + \delta$. Upon completion of the insertion process the components are allowed to return to room temperature. Upon reaching the transformation temperature the nitinol Δ device 10*b* returns to the austenite phase and wants to return to its memory diameter $D_\Delta$. However, the pin 18 is now maintaining the nitinol Δ device 20*a* or 20*b* at $D_\Delta + \delta$. The increase in diameter $\delta$ produces a force as the heat energy gained converts to mechanical energy as the temperature increases from the liquid nitrogen temperature to the transformation temperature. This results in a much greater contact force compared to the contact force developed during the insertion process. Thus the contact retention force, at temperatures above the transformation temperature is much greater than the insertion force, which is made at temperatures below the transformation temperature. If separation of the components is desired the nitinol Δ contact force device 10*b* should be cooled to its martensite phase.

There has therefore been described a system providing electrical connection employing a pin and a socket configured such that after the insertion process is completed the force required for separation is much larger in the ambient temperature state than the insertion force in the low temperature state. This reversal of the normal separation/insertion force relationship results in a connector with longer useful life, increased reliability, low contact resistance, increased resistance to vibration and shock environment, increased resistance to corrosion at the contact surface and increased protection against accidental separation.

The force required to engage or disengage the contacts and the mechanical strength of the bodies containing the pins and the receptacles govern the number of contacts in a multiple circuit connector. In the device described above the maximum force occurs after mating and due to the unique properties of nitinol is minimal during normal procedural insertion and separation operations. Thus, this device is ideally suited for multiple circuit connectors.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. An electrical connector arrangement comprising:

a pin;

a socket receiving said pin; and enclosing means comprising a wire helix, said enclosing means for being placed over said socket and having a common axis with said socket, said enclosing means for having a uniqueness of material so that after insertion of the pin in the socket at a predetermined temperature lower than ambient and cold enough so that said material is in its martensite phase the material is permitted to return to ambient temperature which places the material in its austenite phase and said enclosing means in said austenite phase for gripping said socket and pin so that the separation force of the pin from the socket is much greater than the insertion force, said enclosing means further having a uniqueness of material for being returned to said martensite phase upon said enclosing means being returned to said predetermined temperature.

2. An electrical connector according to claim 1 wherein said socket has a split finger cylinder configuration.

3. An electrical connector according to claim 1 wherein said enclosing means is a spiral wrap cylinder configuration.

* * * * *